US012631422B2

(12) United States Patent
Aral

(10) Patent No.: US 12,631,422 B2
(45) Date of Patent: May 19, 2026

(54) MAGWELL FOR USE WITH FIREARMS

(71) Applicant: SAMSUN YURT SAVUNMA SANAYİ VE TİCARET ANONİM ŞİRKETİ, Tekkeköy (TR)

(72) Inventor: Cahit Utku Aral, Tekkeköy (TR)

(73) Assignee: SAMSUN YURT SAVUNMA SANAYI VE TICARET ANONIM SIRKETI, Samsun (TR)

( * ) Notice: Subject to any disclaimer, the term of this patent is extended or adjusted under 35 U.S.C. 154(b) by 0 days.

(21) Appl. No.: 18/838,995

(22) PCT Filed: Apr. 21, 2022

(86) PCT No.: PCT/TR2022/050360

§ 371 (c)(1),
(2) Date: Aug. 15, 2024

(87) PCT Pub. No.: WO2023/158398

PCT Pub. Date: Aug. 24, 2023

(65) Prior Publication Data

US 2025/0164205 A1 May 22, 2025

(30) Foreign Application Priority Data

Feb. 18, 2022 (TR) ..... 2022/002182

(51) Int. Cl.
*F41C 23/10* (2006.01)
*F41A 35/00* (2006.01)

(52) U.S. Cl.
CPC ..... *F41A 35/00* (2013.01); *F41C 23/10* (2013.01)

(58) Field of Classification Search
None
See application file for complete search history.

(56) References Cited

U.S. PATENT DOCUMENTS

| | | | | |
|---|---|---|---|---|
| 4,520,585 | A * | 6/1985 | Barrett | F41C 23/10 42/7 |
| 5,231,237 | A * | 7/1993 | Cupp | F41C 23/10 42/71.02 |
| 5,666,752 | A * | 9/1997 | Grams | F41A 9/71 42/49.02 |
| 9,897,402 | B2 * | 2/2018 | Pettit | F41A 9/61 |
| 9,945,627 | B2 * | 4/2018 | Porat | F41A 9/65 |
| 10,066,885 | B2 * | 9/2018 | Chen | F41A 9/65 |
| 10,101,105 | B1 * | 10/2018 | Novak | F41A 35/00 |
| 10,161,705 | B2 * | 12/2018 | Keng | F41A 23/04 |
| 10,203,177 | B2 * | 2/2019 | Chavez | F41C 23/10 |
| 10,415,919 | B1 * | 9/2019 | Harrigan | F41C 23/10 |

(Continued)

OTHER PUBLICATIONS

International Search Report and Written Opinion mailed on Oct. 20, 2022 in PCT International Application No. PCT/TR2022/050360.

*Primary Examiner* — Derrick R Morgan
(74) *Attorney, Agent, or Firm* — Jon E. Gordon; Haug Partners LLP

(57) ABSTRACT

The invention is related to a magwell (7) which provides for a more practical placement of the magazine into the magazine bearing and speeding of the magazine changing procedure. The magwell body (1) of the mentioned magwell (7) aims to be detachably attached to the grip secondary element (5) which defines the grip and which can be detachably attached to the grip primary element (4) that is part of the firearm grip.

3 Claims, 4 Drawing Sheets

(56) References Cited

U.S. PATENT DOCUMENTS

| | | | | |
|---|---|---|---|---|
| 10,809,036 | B2 * | 10/2020 | Harrigan | F41C 23/10 |
| 10,852,086 | B1 * | 12/2020 | Hillis | F41A 9/71 |
| 10,921,076 | B1 * | 2/2021 | Thomas | F41A 9/82 |
| 11,073,351 | B2 * | 7/2021 | Tai | F41A 9/61 |
| 11,079,189 | B2 * | 8/2021 | Hsu | F41A 3/66 |
| 11,168,954 | B1 * | 11/2021 | Spykerman | F41A 9/71 |
| 11,454,469 | B2 * | 9/2022 | Nilson | F41A 11/02 |
| 11,473,862 | B2 * | 10/2022 | Oh | F41C 23/16 |
| 2010/0325932 | A1 * | 12/2010 | Zukowski | F41A 17/46 42/6 |
| 2013/0139426 | A1 * | 6/2013 | Baxley | F41C 23/10 42/71.02 |
| 2017/0184359 | A1 * | 6/2017 | Porat | F41A 9/65 |
| 2017/0205168 | A1 | 7/2017 | Chen | |
| 2017/0205188 | A1 * | 7/2017 | Chavez | F41C 23/10 |
| 2018/0051948 | A1 * | 2/2018 | Corso | F41A 9/65 |
| 2019/0017782 | A1 * | 1/2019 | Toole | F41G 1/35 |
| 2019/0107348 | A1 * | 4/2019 | Harrigan | F41A 3/66 |
| 2019/0107349 | A1 * | 4/2019 | Harrigan | F41A 5/02 |
| 2020/0025472 | A1 * | 1/2020 | Landis | F41A 9/65 |
| 2020/0103189 | A1 * | 4/2020 | Cass | F41A 9/71 |
| 2020/0240727 | A1 * | 7/2020 | Taylor | F41A 3/66 |
| 2020/0363158 | A1 | 11/2020 | Glen | |
| 2021/0172702 | A1 * | 6/2021 | Harrigan | F41C 3/00 |
| 2021/0341236 | A1 * | 11/2021 | Hsu | F41A 3/66 |
| 2024/0302117 | A1 * | 9/2024 | Strechinski | F41C 23/14 |
| 2025/0116471 | A1 * | 4/2025 | Ye | F41A 9/71 |
| 2025/0130011 | A1 * | 4/2025 | Underwood | F41C 23/16 |

* cited by examiner

MAGWELL FOR USE WITH FIREARMS

CROSS-REFERENCE TO RELATED APPLICATION(S)

This application is the National Stage entry under 35 U.S.C. § 371 of International Application No. PCT/TR2022/050360, filed on Apr. 21, 2022, published on Aug. 24, 2023 under Publication Number WO 2023/158398 A1, which claims the benefit of priority under 35 U.S.C. § 119 of Türkiye Patent Application Number 2022/002182, filed on Feb. 18, 2022, the entireties of which are herein incorporated by reference.

TECHNICAL FIELD

The invention is related to a magwell which provides for a more practical placement of the magazine into the magazine bed and speeding of the magazine changing procedures.

STATE OF THE ART

The main purpose of the magwell is to place the magazine into the magazine bearing in the body swiftly in any position and provide rapid magazine change. The magwell provides for the magazine to be guided and seated while creating a surface area for the hand to grip the bottom. Thereby, it contributes to gun control as it helps changing the magazine rapidly.

In fact, magwells are guides that can be used with the purpose of the gun user to load the magazine into the gun easily and effortlessly. These guides have more importance especially for the competition shooters. For the competition shooters to reach their desired speed, they need to insert the new magazine into the gun rapidly without moving their gaze from the target. Since they enable rapid and consistent loading, magwells can create important advantages in the total score of the shooter in competitions.

Magwells can enable rapid loading by enlarging the opening of the magazine entrance on the grip by channelizing the magazines that were driven to the well towards the opening in an entry form due to their funnel-shaped structures and wall formations at different angles.

Thanks to the magwell again, the enlarged portion formed at the bottom of the grip will give the user an important advantage in terms of gripping the gun and will be a reason for preference by the competition shooters.

The fact that the bottom of the pistol is not extended and short in uses without magwells, they cause the user to be unable to grip the pistol grip completely and use the same effectively. Especially in rapid magazine changes, it provides the magazine to be seated into the housing within the body by serving as a funnel. The magwell use by the user will increase their domain and support their control over the pistol.

Patent application number US202002547 describes a magwell which can be used for semi-automatic weapons. It is understood that the embodiment as the subject of the invention is an apparatus for elongating the magwell of a firearm. In order to connect the mentioned apparatus to the gun, it has an expandable fixing mechanism that can selectively expand against the internal clearance adjacent to the magazine housing.

U.S. patent application Ser. No. 10/921,076 describes a magwell adapter aiming to be used for firearms.

It is understood that the mentioned adapter can be slidably connected to the bottom of the grip portion of the firearm.

According to the application, the adapter may comprise an opening for receiving a protrusion and holding the winding spring in place within the grip portion. Again, the adapter may comprise at least one pin-receiving opening on the rear end and this opening can be configures to receive a main spring housing pin to connect the main spring housing to the adapter.

As exemplified above, magwells can be connected to the grip by means of various connection mechanisms. When the pressure and vibration the gun creates as it is shot is considered, there can be loosening and displacement of the magwell connection components. The deformations created at the moment of shooting can influence the shooting performance of the user.

Since magwells render gun use swift and practical, performing the connection of the magwells to be used to the gun practically can be demanded by the users. Most of the time, complex connection mechanisms can be stably connected to the magazine and eliminate or reduce the problems of loosening and displacement. However, since these mechanisms will make practical and rapid connection to the gun more difficult, they may create a disadvantage for the users.

Problems Aimed to be Solved by the Invention

The purpose of the invention is to provide a magwell in which the loosening and displacement problems are reduced by both making the mounting-demounting of the magazine more rapid and practical, and stabilizing the grip connection.

Since more rapid and practical mounting of the magwell as the subject of the invention is enabled, it can be mounted to the grip easily and effortlessly.

Despite easy montage, since the magwell is stably connected to the grip, possible loosening and displacement problems can be minimized.

With the use of the magwell as the subject of the invention it is provided for the magazine to be guided and seated in place, while creating a surface area for the hand to grip the bottom. Thereby, it will be able to contribute to gun control as it helps changing the magazine rapidly.

DESCRIPTION OF THE REFERENCES IN THE FIGURES

Figure 1:
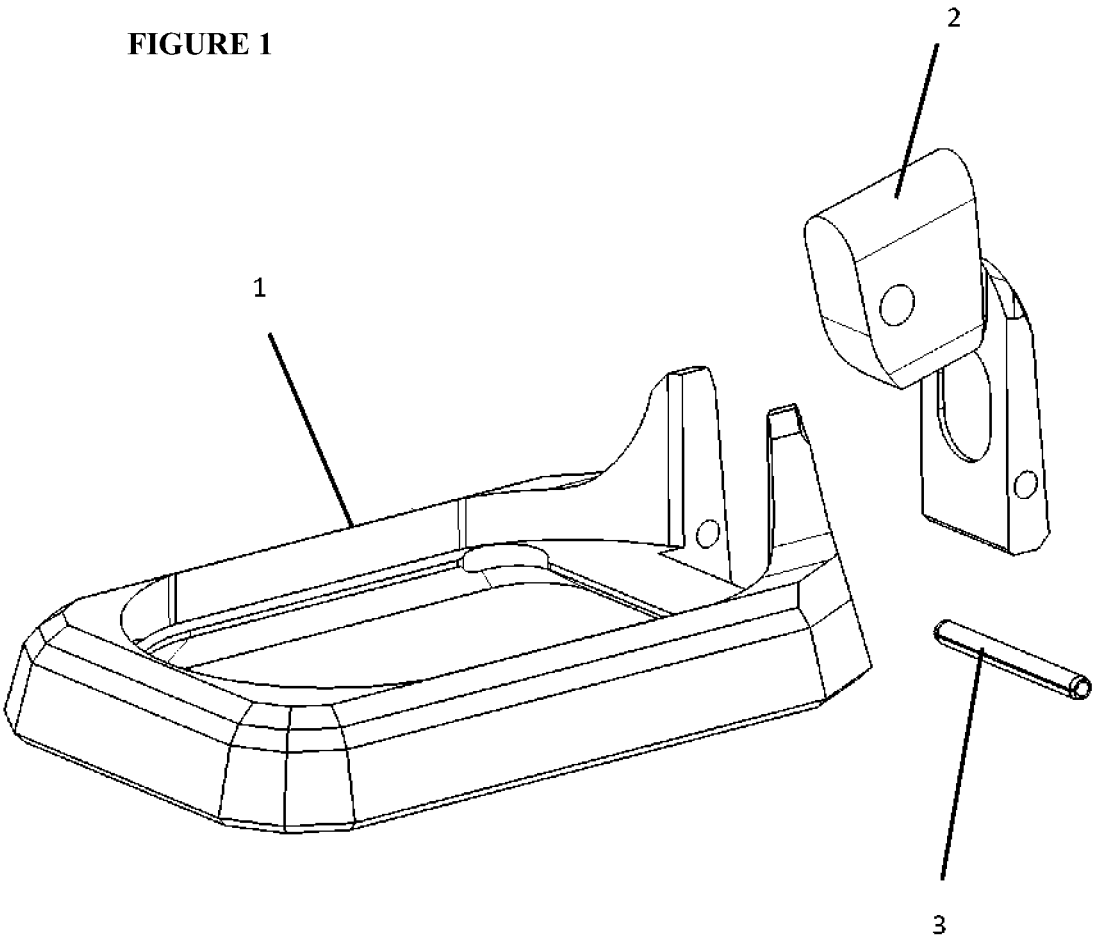
FIG. 1. Sectional isometric view of the magwell.
Figure 2:
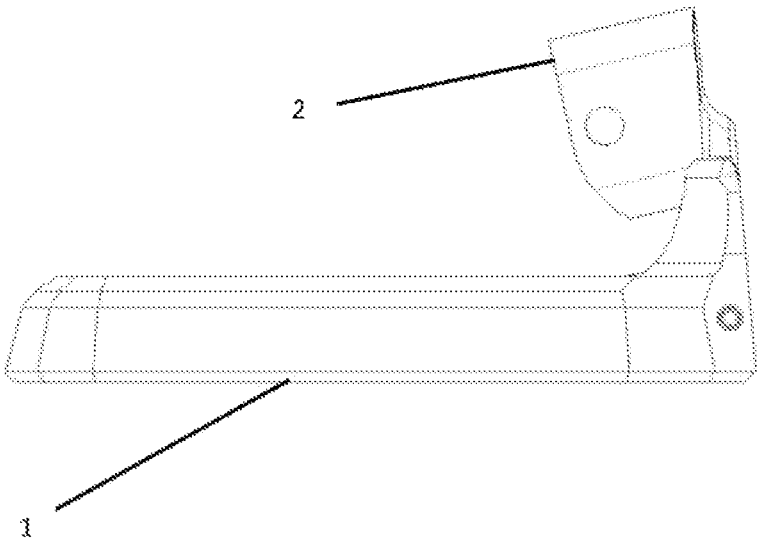
FIG. 2. Left view of the magwell.
Figure 3:
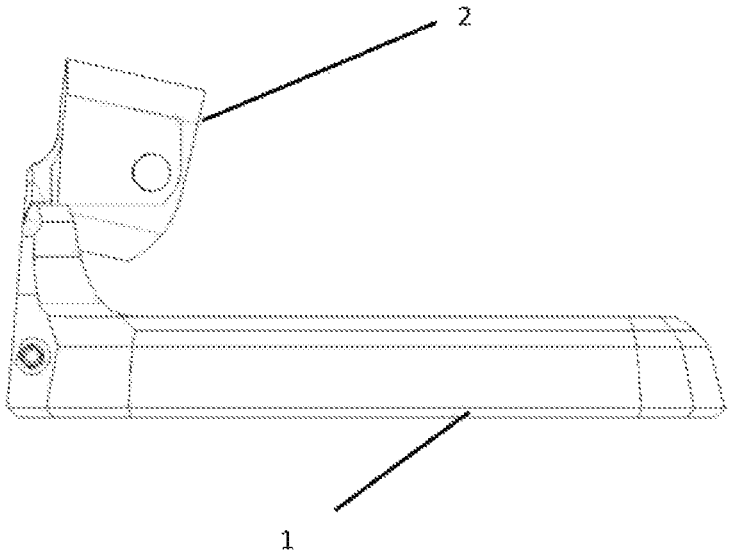
FIG. 3. Right view of the magwell.
Figure 4:
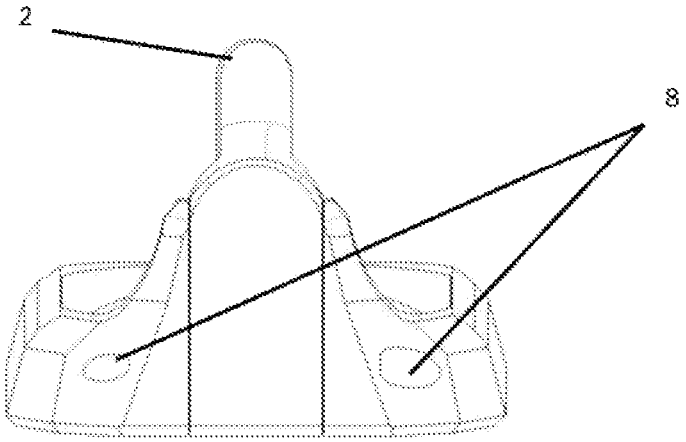
FIG. 4. Rear view of the magwell.
Figure 5:
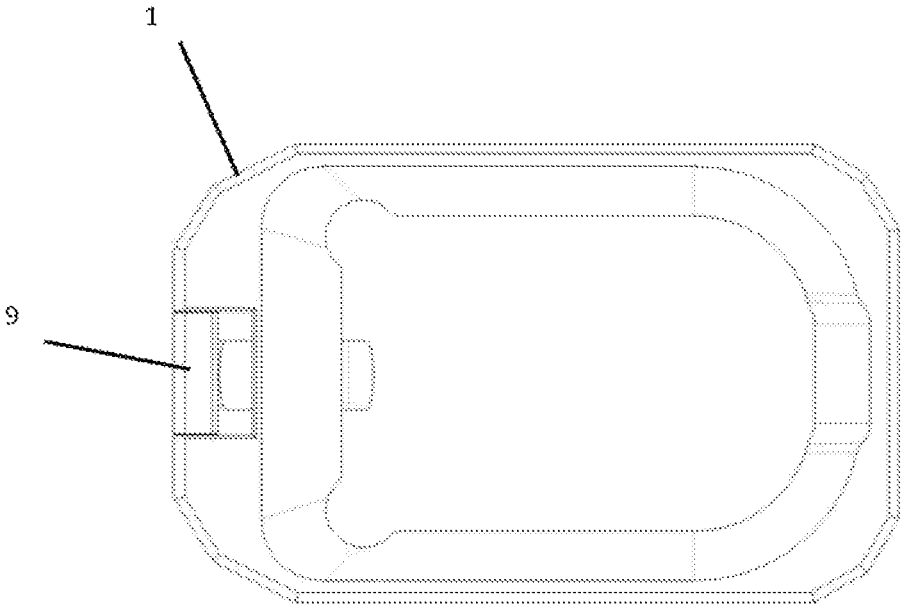
FIG. 5. Top view of the magwell.

1. Magwell body
2. Magwell knuckle
3. Magwell connection element
4. Grip primary element
5. Grip secondary element
6. Grip connection element
7. Magwell
8. Magazine pin hole
9. Knuckle placement clearance
10. Grip pin hole
11. Grip placement clearance
12. Knuckle hole

DESCRIPTION OF THE INVENTION

The invention is related to a magwell (7) which provides for a more practical placement of the magazine into the magazine bearing and speeding of the magazine changing procedure.

The magwell body (1) of the mentioned magwell (7) aims to be detachably attached to the grip secondary element (5) which defines the grip and which can be detachably attached to the grip primary element (4) that is part of the firearm grip.

The mentioned magwell body (1) comprises walls which have been angled to direct the magazine during positioning, and a wider opening, with the purpose of being more easily positioned within the magazine bed.

The magwell body (1) comprises at least one magwell knuckle (2) which aims to be interlocked with the knuckle placement clearance (9) of the grip secondary element (5) with the axial movement around the magwell connection element (3), associated with the magwell body (1) such that it can axially move around at least one magwell connection element (3).

The interlocking detail of the magwell knuckle (2) is placed within the grip placement clearance (11) of the grip secondary element (5) with the axial movement of the magwell knuckle (2) in a direction centered to the magwell connection element (3). With this interlocking, the magwell (7) can be connected to the gun.

With an axial movement in the opposite direction, the connection between the magwell (7) gun details can be severed.

According to FIG. 1, in which a preferred embodiment of the invention is described, the magwell connection element (3) has a pin form and aims to be placed within the magazine pin hole (8) formed on the magwell body (1).

Within the scope of this embodiment, a detail of the magwell knuckle (2) aims to be placed within the knuckle placement clearance (9) formed on the magwell body (1). Following this positioning, the pin passes through the magazine pin hole (8) and the hole formed on the detail of the magwell knuckle (2), and the connection is completed. Thanks to the structure of this connection, the magwell knuckle (2) can move around the pin axially.

This embodiment will enable the magwell body (1) to be mounted and demounted to the gun by changing the axial positions of the user.

Consequently, the magwell knuckle (2) is an intermediate piece which provides for the magwell knuckle (7) to be fixed to the grip. It provides visual and ergonomic improvement.

The magwell connection element (3) is the piece which helps combining the magazine body (1) and the magwell knuckle (2). Thanks to this fixing procedure, loosening and partial movement of the magwell knuckle (2) in a possible situation is prevented.

The magwell body (1) is a piece which aims to be connected to the magazine clearance created at the end of the pistol grip gripping area formed by the grip primary element (4) and the grip secondary element (5) and as a result, increases its efficiency.

In order to complete the connection of the magwell knuckle (2) with the gun, additionally, the grip connection element (6) is used.

Figure 6:
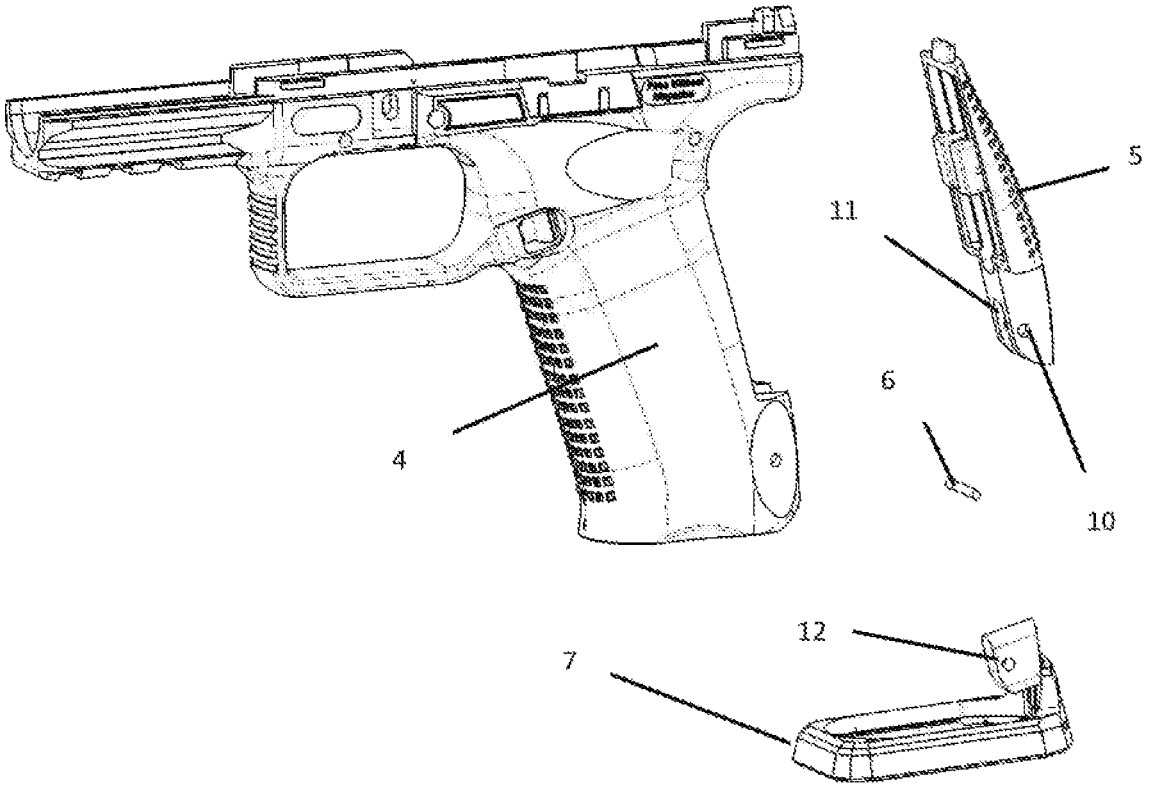
FIG. 6. Partially exploded view illustrating relative positions of elements including grip and magwell.

According to FIG. 6, the grip connection element (6) is created in the pin form. This pin fixes the connection by passing through the knuckle hole (12) formed on the magwell knuckle (2) and the grip pin hole (10). By this means, the position of the magwell knuckle (2) within the knuckle placement clearance (9) is fixed.

After the connection element (6) created in pin form is passed from the mentioned holes (10,12), the connection can be completed by additionally connecting the same to the holes formed on the gun grip.

The invention claimed is:

1. A magwell apparatus for use with a firearm, comprising:

a magwell body configured to be detachably connected to a secondary grip element, the secondary grip element being detachably connected to a primary grip element that forms part of the firearm grip; and at least one magwell knuckle movably connected to the magwell body;

wherein each magwell knuckle is pivotally connected to the magwell body via at least one magwell connection pin extending through a corresponding opening in the magwell body and the magwell knuckle, such that the magwell knuckle is rotatable about the connection pin;

wherein the magwell knuckle is configured to engage with a knuckle placement clearance by axial rotation about the connection pin, thereby enabling assembly and secure attachment of the magwell apparatus to the secondary grip element; and wherein the magwell body comprises angled walls configured to guide a magazine into the magazine well of the firearm and facilitate magazine exchange.

2. The magwell apparatus of claim 1, wherein the magwell comprises a grip connection element configured to pass through a knuckle hole formed on the magwell knuckle and the grip pin hole, thereby securing the connection.

3. The magwell apparatus of claim 2, wherein the grip connection element is in the form of a pin.

* * * * *